US006336380B1

(12) United States Patent
Lin

(10) Patent No.: US 6,336,380 B1
(45) **Date of Patent: *Jan. 8, 2002**

(54) POUNDING TOOL

(76) Inventor: Chung-Chiang Lin, No. 1, Lane 28, Tai Chou Street, He Nan Li, Hsi Chun Area, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/487,794

(22) Filed: Jan. 20, 2000

(30) Foreign Application Priority Data

Apr. 29, 1999 (TW) ..... 88206710 U

(51) Int. Cl.[7] ..... B25D 1/12
(52) U.S. Cl. ..... 81/22
(58) Field of Search ..... 81/20, 22, 489, 81/177.1

(56) References Cited

U.S. PATENT DOCUMENTS 811,390 A * 1/1906 Foreman ..... 81/489
4,721,021 A * 1/1988 Kusznir ..... 81/22
4,738,166 A * 4/1988 Yamaguchi ..... 81/22
5,911,795 A * 6/1999 Tucker ..... 81/22
6,170,362 B1 * 1/2001 Chen ..... 81/22

* cited by examiner

*Primary Examiner*—Joseph J. Hail, III
*Assistant Examiner*—David B. Thomas
(74) *Attorney, Agent, or Firm*—Browdy and Neimark

(57) ABSTRACT

A pounding tool comprises a head, and a handle which is connected at one end thereof with the head and is provided with a protective jacket fitted thereover to facilitate the gripping of the handle with hand. The protective jacket is provided with a plurality of shock-absorbing through holes which are arranged in rows along the longitudinal direction of the protective jacket. The handle has a top side and a bottom side, and a direction formed from the top side to the bottom side. The head has a pounding direction which is the same as the direction which is formed from the top side to the bottom side of the handle. The through holes are located over the top side and under the bottom side of the handle.

8 Claims, 4 Drawing Sheets

POUNDING TOOL

FIELD OF THE INVENTION

The present invention relates generally to a pounding tool, and more particularly to a hammer.

BACKGROUND OF THE INVENTION

As shown in FIG. 1, a prior art hammer 5 comprises a main body 60 and a protective jacket 70.

The main body 60 has a head 61 and a handle 62 which is provided with a top side 621 and a bottom side 622. The direction extending from the top side 621 to the bottom side 622 is the same as the pounding direction of the head 61.

The protective jacket 70 is made of a plastic material by injection molding and is fitted over the handle 62 to facilitate the gripping of the handle 62.

Such a prior art hammer 5 as described above is defective in design in that the reaction force, which is brought to pass by the pounding action of the head 61, is transmitted via the handle 62 and the protective jacket 70 to the hand holding the hammer 5, thereby resulting in the numbness of the hand.

With a view to overcoming the drawback of the prior art hammer 5, another prior art hammer 6 is provided on the protective jacket 80 thereof with two straight troughs 81 extending along the direction of the longitudinal axis of the protective jacket 80 such that the two troughs 81 are corresponding in location to the top side 91 and the bottom side 92 of the handle 90 for absorbing the shock wave. The protective jacket 80 is effective in mitigating the reaction force that is brought about by the pounding action of the hammer 6; nevertheless the protective jacket 80 is not cost-effective. The troughs 81 of the protective jacket 80 are formed by drilling or injection molding. The drilling method is technically difficult and time-consuming, whereas the method of injection molding is technically infeasible because of the design problem of the molding tool and the problem of releasing the protective jacket from the molding tool in which the protective jacket is formed. For example, the molding tool must be provided with two long molding columns for forming the troughs 81. The molding columns are vulnerable to deformation or severance.

SUMMARY OF THE INVENTION

The primary objective of the present invention is therefore to provide a pounding tool which is free from the drawbacks of the prior art pounding tools described above.

In keeping with the principle of the present invention, the foregoing objective of the present invention is attained by a pounding tool with a protective jacket which is fitted over the handle of the pounding tool and is provided with a plurality of shock-absorbing holes which are arranged in two rows and are respectively located over the top side of the handle and under the bottom side of the handle.

DETAILED DESCRIPTION OF THE INVENTION

Figure 1:
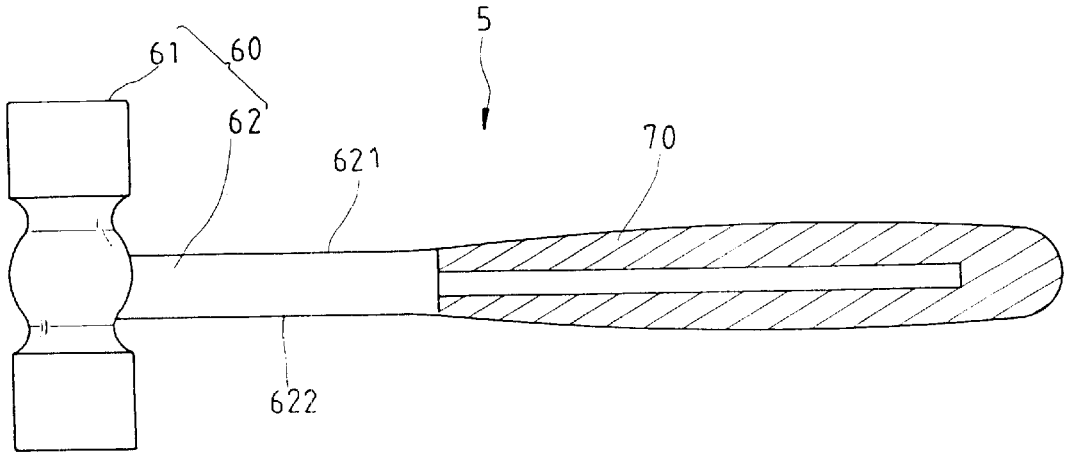
FIG. 1 PRIOR ART
FIG. 1 shows a longitudinal sectional view of a prior art pounding tool.
Figure 2:
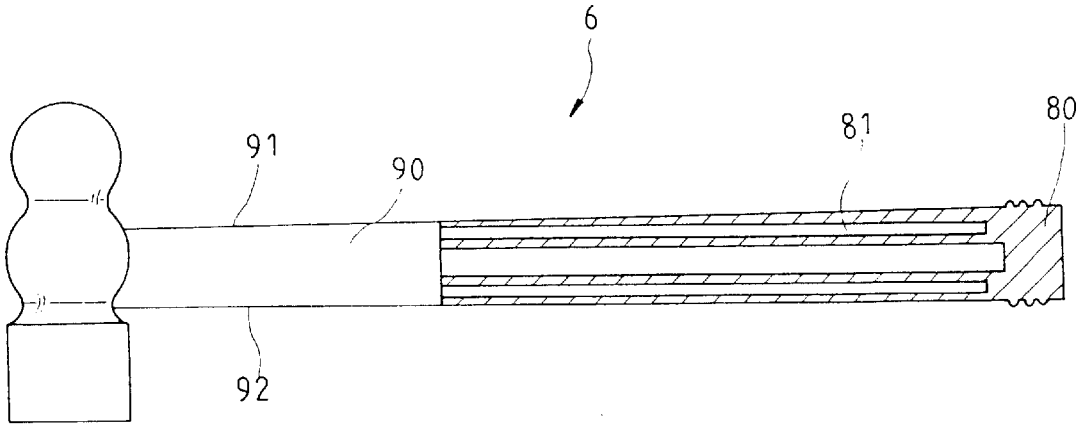
FIG. 2 PRIOR ART
FIG. 2 shows a longitudinal sectional view of another prior art pounding tool.
Figure 3:
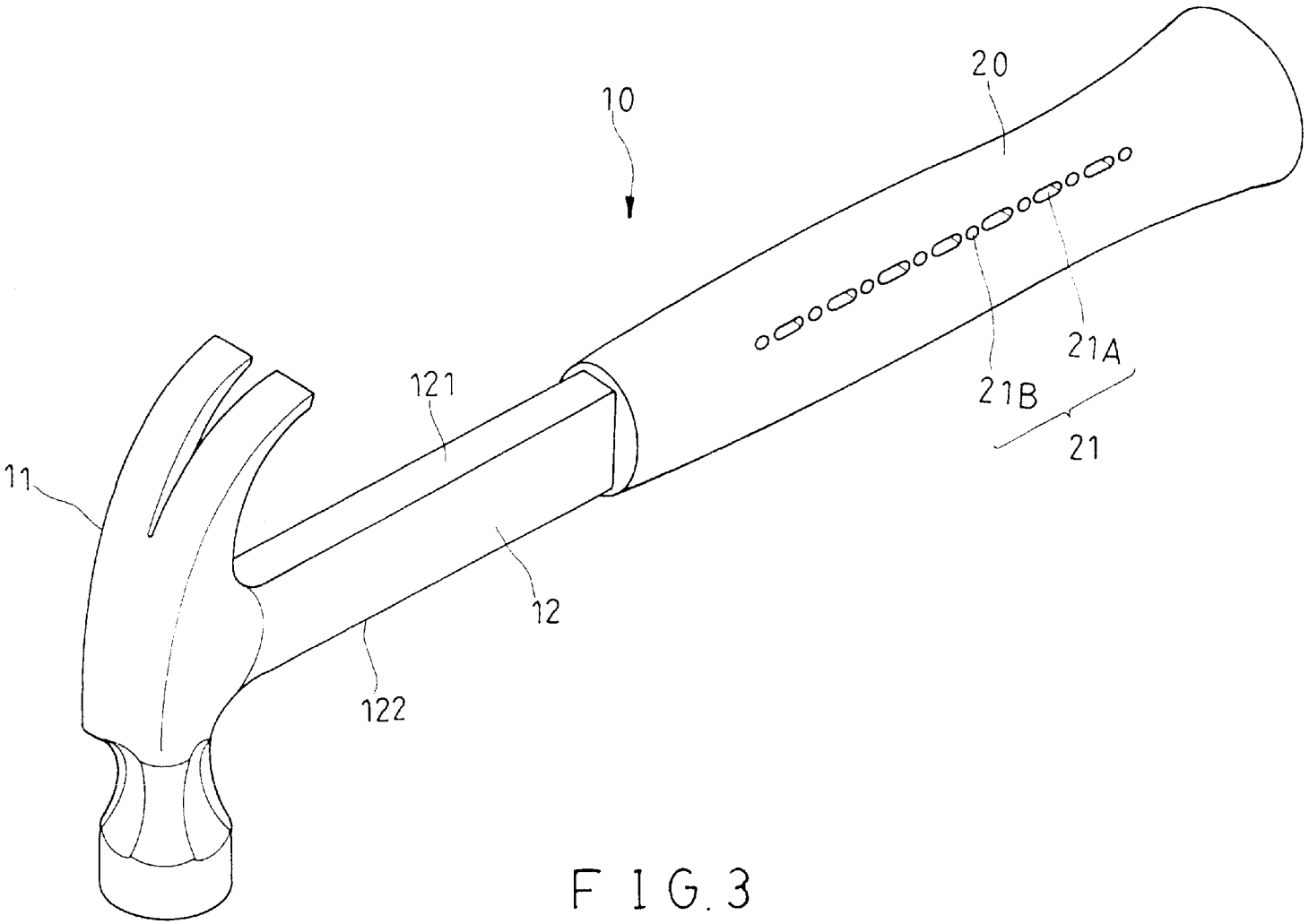
FIG. 3 shows a perspective view of a first preferred embodiment of the present invention.
Figure 5:
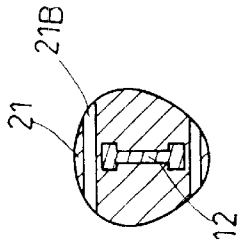
FIG. 5 shows a sectional view of a portion taken along the direction indicated by a line 5—5 as shown in FIG. 4.
Figure 4:
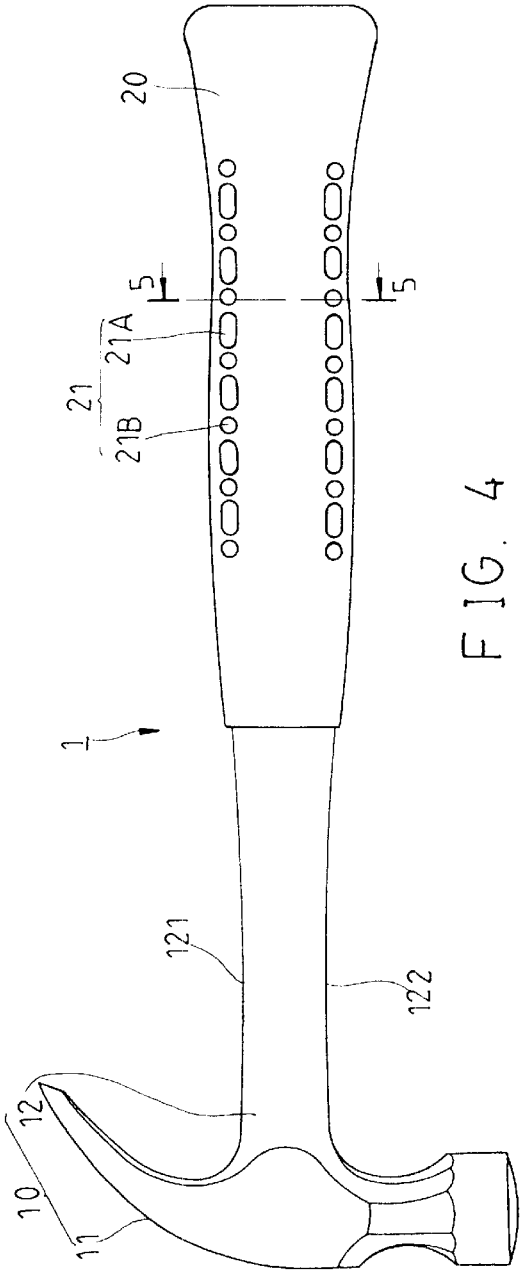
FIG. 4 shows a side view of the first preferred embodiment of the present invention.

As shown in FIGS. 3–5, a hammer 1 embodied in the present invention comprises a main body 10 and a protective jacket 20.

The main body 10 has a head 11, and a handle 12 connected at one end thereof with the head 11 and provided with a top side 121 and a bottom side 122. The direction formed from the top side 121 to the bottom side 122 is the same as the pounding direction of the head 11.

The protective jacket 20 is made of a plastic material by injection molding and is fitted over the handle 12 to facilitate the gripping of the handle 12. The protective jacket 20 is provided with a plurality of through holes 21 extending from one side thereof through other side thereof. The through holes 21 are of two forms, namely, oblong through holes 21A and round through holes 21B. The oblong through holes 21A and the round through holes 21B are arranged alternately and linearly in two rows along the longitudinal direction of the protective jacket 20 and are located respectively over the top side 121 and under the bottom side 122 of the handle 12.

A reaction force is brought about by the pounding action of the head 11 such that the reaction force is transmitted to the protective jacket 20 in which the reaction force is partially absorbed by the through holes 21 of the protective jacket 20. As a result, the shock wave is so minimized that it does not cause a painful or numb feeling in the hand holding the hammer 1.

The through holes 21 of the protective jacket 20 of the present invention are relatively shallow and can be therefore drilled with ease. In addition, the through holes 21 can be made integrally with the protective jacket 20 by injection molding. The design of the molding tool is also less complicated as compared with that of the prior art molding tool. As a result, the protective jacket 20 of the present invention is relatively cost-effective.

Figure 7:
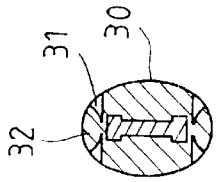
FIG. 7 shows a sectional view of a portion taken along the direction indicated by a line 7—7 as shown in FIG. 6.
Figure 6:
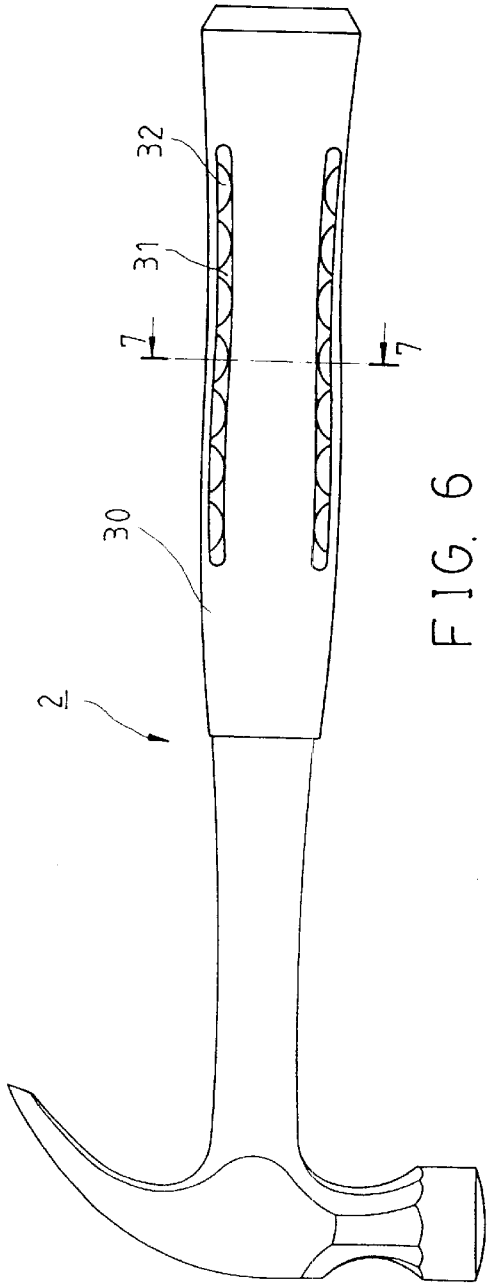
FIG. 6 shows a side view of a second preferred embodiment of the present invention.
Figure 9:
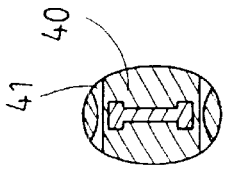
FIG. 9 shows a sectional view of a portion taken along the direction indicated by a line 9—9 as shown in FIG. 8.
Figure 11:
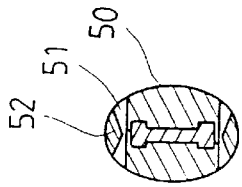
FIG. 11 shows a sectional view of a portion taken along the direction indicated by a line 11—11 as shown in FIG. 10.
Figure 8:
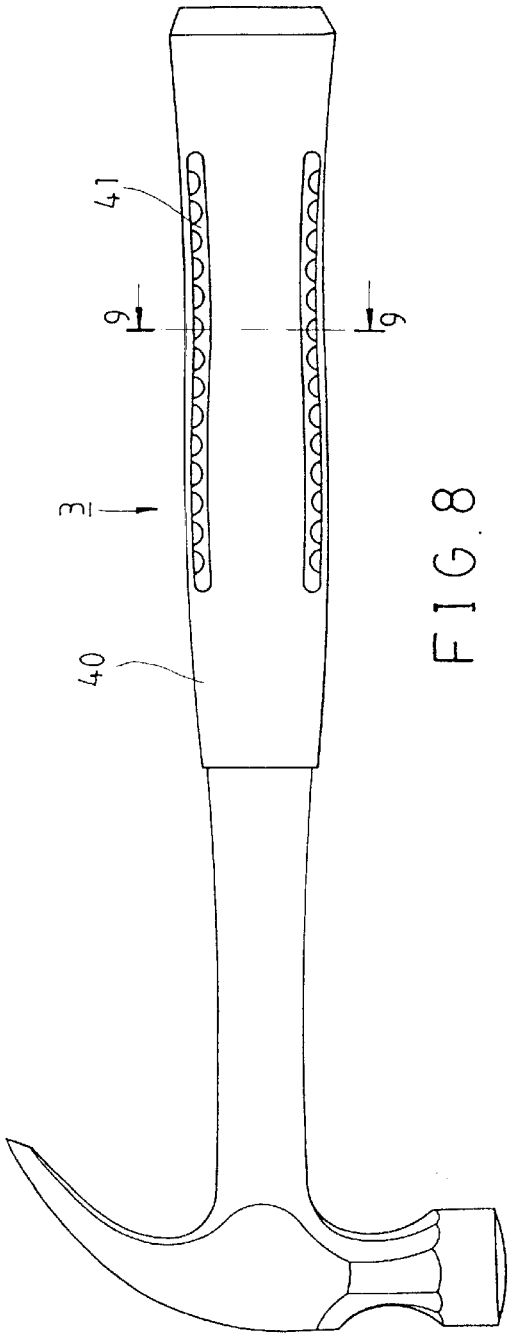
FIG. 8 shows a side view of a third preferred embodiment of the present invention.
Figure 10:
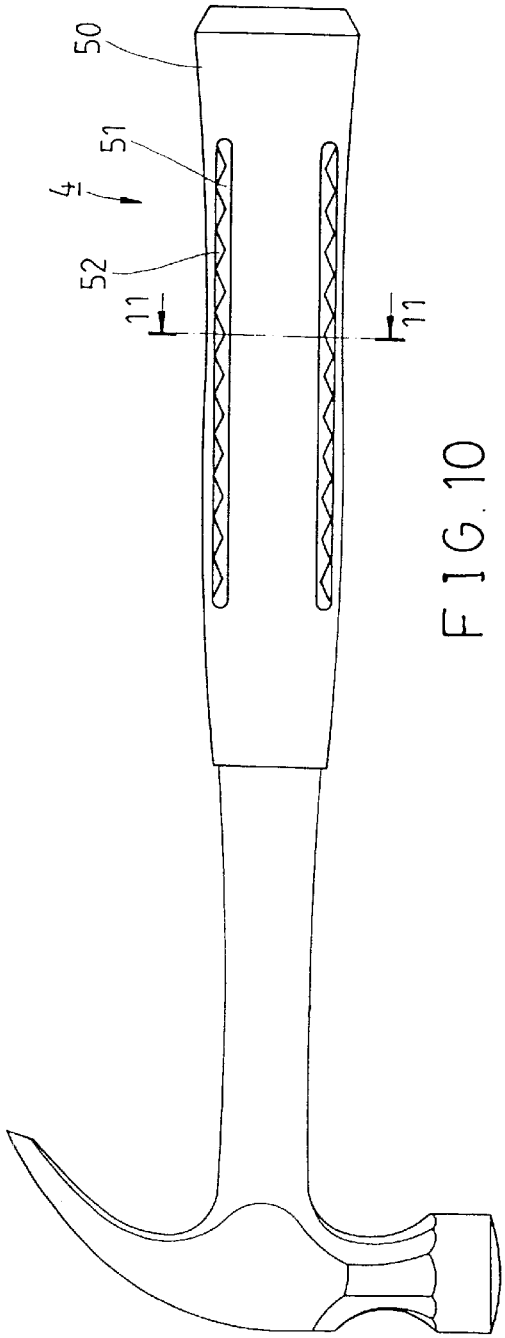
FIG. 10 shows a side view of a fourth preferred embodiment of the present invention.

The through holes of the protective jacket 20 of the present invention may be various in pattern. As shown in FIGS. 6 and 7, a hammer 2 of the second preferred embodiment of the present invention comprises a protective jacket 30 which is provided with a plurality of through holes 31 and partitions 32 of a semispherical construction. Now referring to FIGS. 8 and 9, a hammer 3 of the third preferred embodiment of the present invention is shown comprising a protective jacket 40 which is provided with a plurality of through holes 41 in communication with one another. As shown in FIGS. 10 and 11, a hammer 4 of the fourth preferred embodiment of the present invention comprises a protective jacket 50 which is provided with a plurality of through holes 51 which are basically similar to the through holes 41 of the third preferred embodiment described above, with the exception being that the partitions 52 of the protective jacket 50 are tapered in shape.

What is claimed is:

1. A pounding tool comprising:

a pounding body having a pounding head;

a handle fastened at one end thereof with said pounding body so that an axis of the pounding head is substantially perpendicular to a longitudinal axis of the handle;

the handle having a top side and a bottom side;

wherein a distance between the top side and the bottom side which is perpendicular to the longitudinal axis of the handle is also parallel to the axis of the pounding head;

a protective jacket fitted over said handle to facilitate the gripping of the handle;

the protective jacket having a first plurality of through holes located above the top side of the handle and a second plurality of through holes located below the bottom side of the handle; and wherein each of the first and second plurality of through holes has an axis perpendicular to the longitudinal axis of the handle and parallel respectively to the top side and the bottom side of the handle so that the through holes open on opposite sides of the protective jacket.

2. The pounding tool as defined in claim 1, wherein said through holes comprise a plurality of oblong through holes alternating with a plurality of round through holes.

3. The pounding tool as defined in claim 1, wherein said protective jacket is provided with a plurality of partitions, each being located between adjacent through holes.

4. The pounding tool as defined in claim 3, wherein said partitions are of a semispherical construction.

5. The pounding tool as defined in claim 3, wherein said partitions are of a tapered construction.

6. The pounding tool as defined in claim 1, wherein the protective jacket is formed by injection molding.

7. The pounding tool as defined in claim 6, wherein the through holes are made integrally with the protective jacket when formed by injection molding.

8. The pounding tool as defined in claim 6, wherein the through holes are drilled into the protective jacket after being formed by injection molding.

* * * * *